US009752314B2

(12) United States Patent
Wiebke

(10) Patent No.: US 9,752,314 B2
(45) Date of Patent: Sep. 5, 2017

(54) FLUID OUTLET UNIT

(71) Applicant: Ronald W. Wiebke, Elberon, IA (US)

(72) Inventor: Ronald W. Wiebke, Elberon, IA (US)

( * ) Notice: Subject to any disclaimer, the term of this patent is extended or adjusted under 35 U.S.C. 154(b) by 0 days.

(21) Appl. No.: 14/270,767

(22) Filed: May 6, 2014

(65) Prior Publication Data

US 2015/0322654 A1 Nov. 12, 2015

(51) Int. Cl.

| | |
|---|---|
| ***E03D 11/00*** | (2006.01) |
| ***E03C 1/12*** | (2006.01) |
| ***E03F 5/04*** | (2006.01) |
| ***E03C 1/22*** | (2006.01) |
| ***E03C 1/284*** | (2006.01) |

(52) U.S. Cl.
CPC ..... *E03F 5/0409* (2013.01); *E03C 1/22* (2013.01); *E03C 1/284* (2013.01)

(58) Field of Classification Search
CPC ..... E03C 1/22; E03D 11/16
USPC ..... 4/679, 251.1
See application file for complete search history.

(56) References Cited

U.S. PATENT DOCUMENTS

| | | | | |
|---|---|---|---|---|
| 2,499,115 | A * | 2/1950 | Shobe | E03D 1/00 210/499 |
| 4,146,939 | A | 4/1979 | Izzi | |
| 7,934,516 | B1 * | 5/2011 | Jaynes | E03D 11/16 137/312 |
| 2003/0159978 | A1 | 8/2003 | Self et al. | |
| 2009/0307837 | A1 * | 12/2009 | Gan | E03C 1/26 4/679 |
| 2010/0175761 | A1 | 7/2010 | Schlueter | |
| 2010/0320130 | A1 * | 12/2010 | Meyers | E03F 5/0409 210/164 |
| 2012/0048070 | A1 | 3/2012 | Richter | |
| 2013/0305443 | A1 * | 11/2013 | Baranj | E03D 11/16 4/251.1 |

* cited by examiner

*Primary Examiner* — Christine Skubinna
(74) *Attorney, Agent, or Firm* — Shuttleworth & Ingersoll, PLC; Jason Sytsma

(57) ABSTRACT

A fluid outlet includes a top side with a plurality of grooves to channel moisture into a basin. A drain pipe port at the bottom of the basin channels moisture into the drain pipe. The outlet can be made from a single unitary polymer that can be cut to fit into any location.

13 Claims, 5 Drawing Sheets

FLUID OUTLET UNIT

FIELD OF THE INVENTION

This disclosure relates to a fluid outlet unit, and more specifically, to a fluid outlet unit for draining moisture that collects around the unit.

BACKGROUND OF THE INVENTION

A fluid outlet unit for a shower, stool, or water closet generally comprises an apertured top grille part and a bottom part that connects to a drain pipe. Waste water from the shower tray drains over and through the apertures of the top grille part into the bottom part and into the drain pipe. Such units fail to include a way of removing moisture that accumulates around the unit.

SUMMARY

A fluid outlet is disclosed. The fluid outlet includes a top side with a plurality of grooves to channel moisture into a basin. A drain pipe port at the bottom of the basin channels moisture into the drain pipe. The outlet can be made from a single unitary polymer that can be cut to fit into any location. Generally, the top side is at least substantially thirty five and eleven-sixteenths inches (35 11/16") long and at least substantially three-quarters inches (¾") thick.

DETAILED DESCRIPTION

Figure 1:
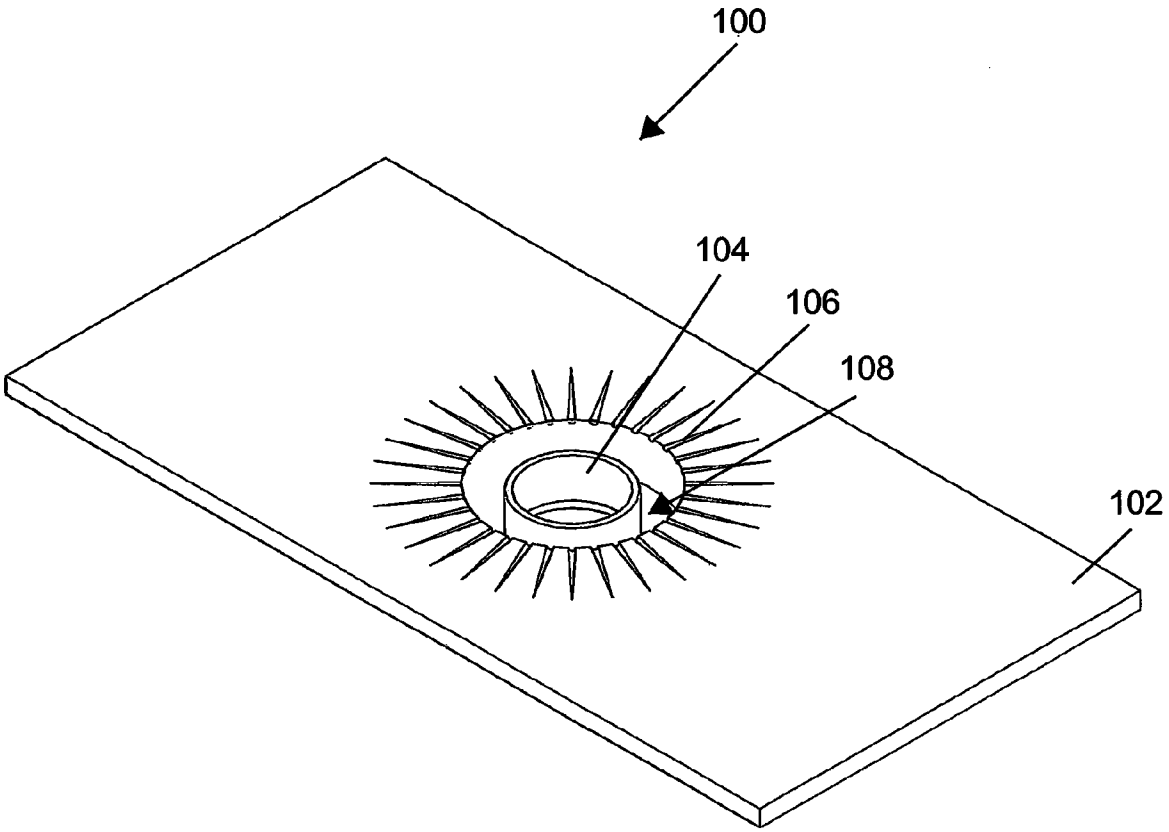
FIG. 1 is a perspective view of a base plate for a waste water outlet according to an embodiment of this disclosure.
Figure 2:
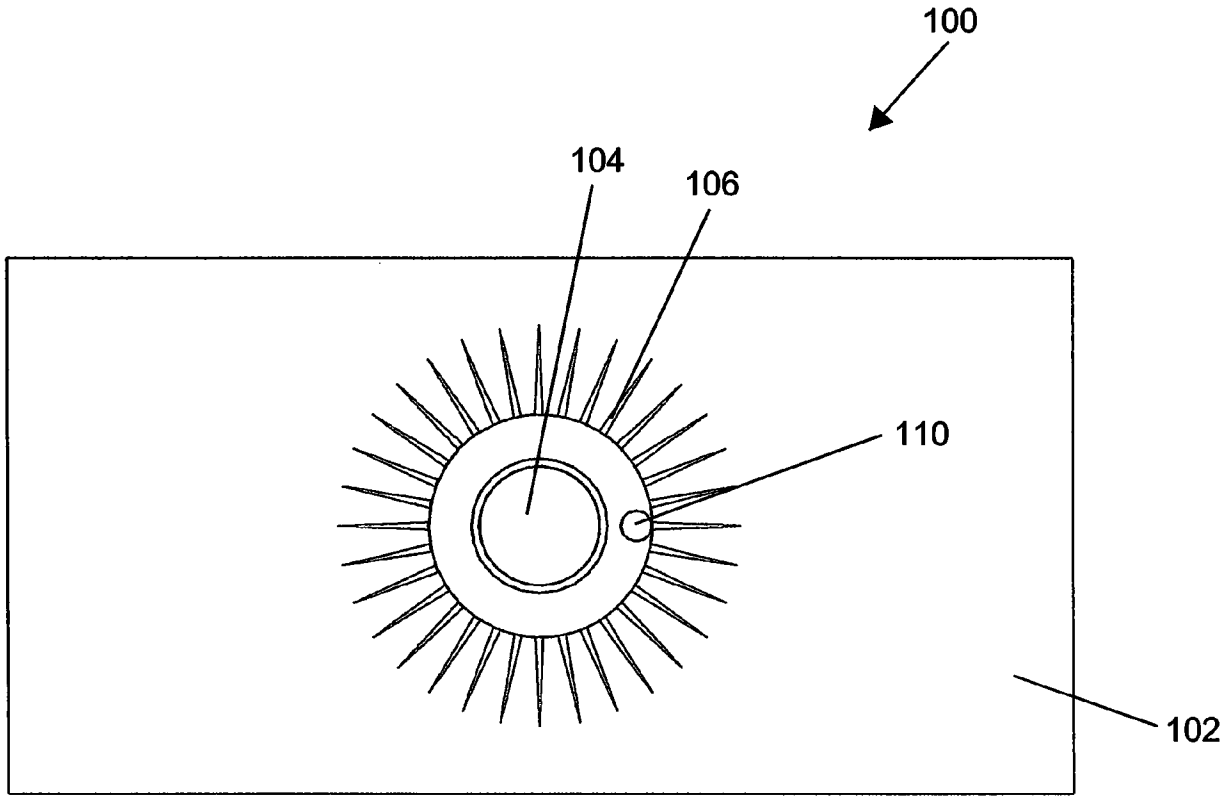
FIG. 2 is a top view of the base plate of FIG. 1.

FIG. 1 shows a fluid outlet unit 100. Unit 100 includes a base plate 102 housing a drain pipe port 104 that is connected to a drain pipe for draining fluid from a shower, stool, or water closet. Base plate 102 is sized to fit with the subfloor. In that regard, base plate 102 can be ¾" thick, which is the thickness of the subfloor in most commercial and residential building projects.

Base plate 102 can be adjusted from side-to-side to obtain the desired placement of drain pipe port 104, which will be in line with the drain for the shower, stool, or water closet. The width of base plate 102 is of a sufficient length to allow for the space between drain pipe port 104 and the back wall of the room where unit 100 is being placed.

In an embodiment, base plate 102 can be substantially eighteen inches (18") wide and substantially thirty five and eleven-sixteenths inches (35 11/16") long to fit a wide variety of spacings between floor joists in the building trade. One skilled in the art will recognize that the term substantially allows for tolerances typically acceptable in the building trade.

Figure 3:
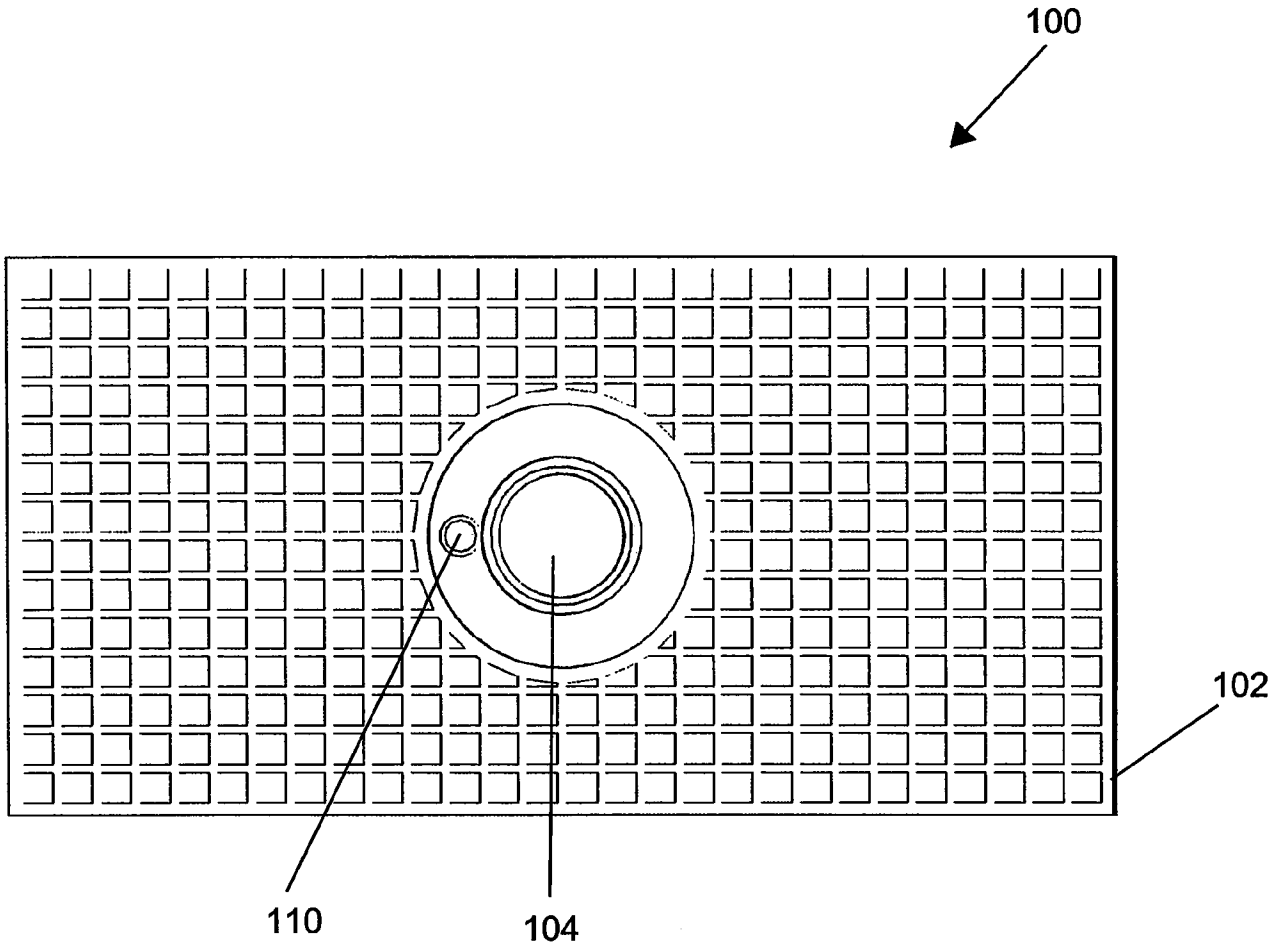
FIG. 3 is a bottom view of the base plate of FIG. 1.
Figure 4:
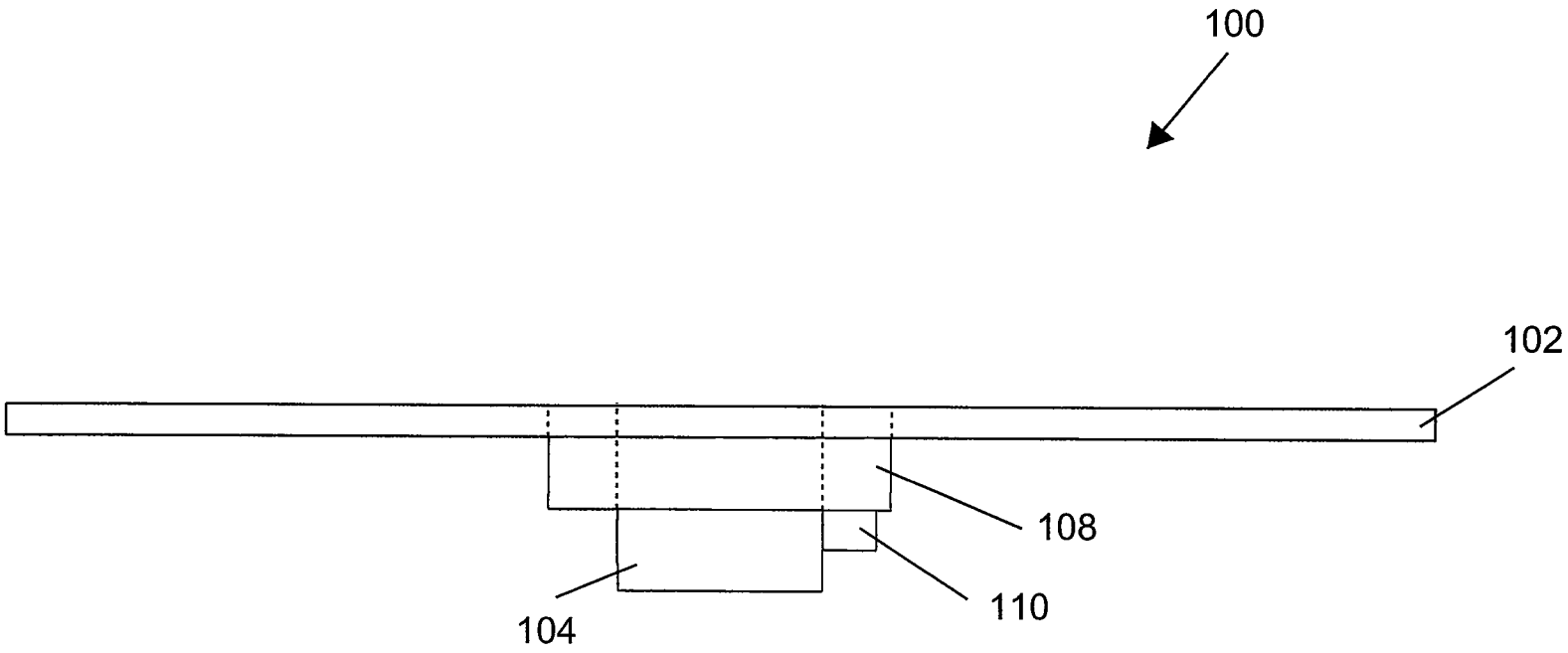
FIG. 4 is a side view of the base plate of FIG. 1.

Base plate 102 can be made from a molded polymer material, such as polyvinyl chloride (PVC), and can be made as a single unitary piece of material. The underside of base plate 102 (shown in FIG. 3) can be waffled to reduce weight and cost of manufacture.

Figure 5:
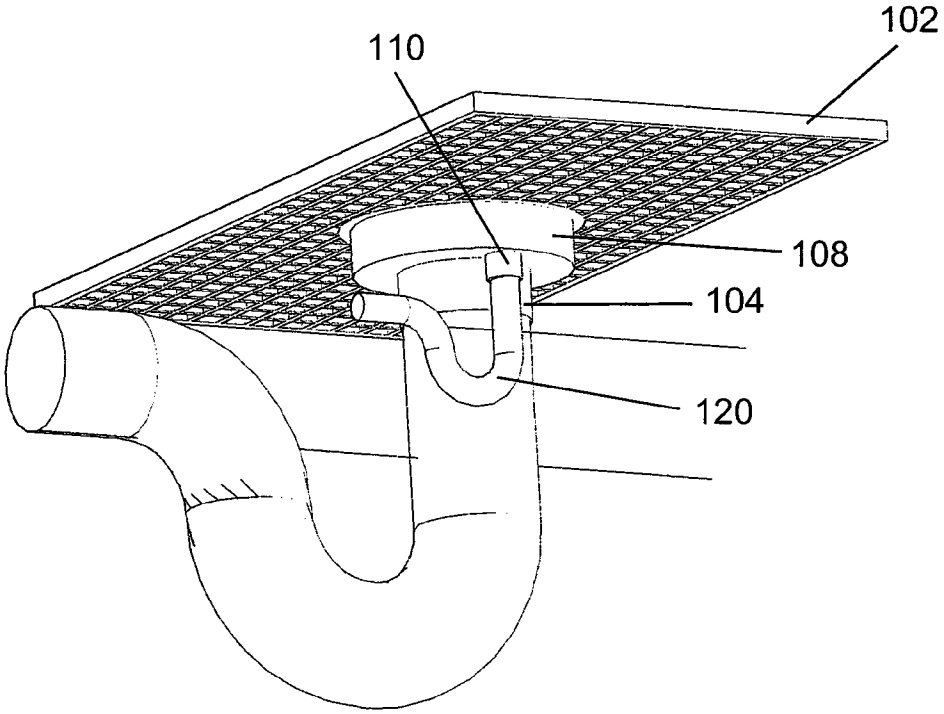
FIG. 5 shows the base plate of FIG. 1 connected to a drain pipe and trap.

Fluid outlet unit 100 further includes a plurality of grooves 106 surrounding drain pipe port 104. In the illustrated embodiment there are 32 grooves, but more or less grooves are contemplated. Grooves 106 channel moisture that accumulates between base plate 102 (which is coplanar with the baseboard) and the shower, stool, or water closet. Grooves 106 channel moisture into a basin 108 that surrounds drain pipe port 104. Grooves 106 have a slope toward basin 108 so that the moisture flows into basin 108. Accumulated moisture in basin 108 is drained through an outlet 110 in the bottom of basin 108 into the drain pipe. In this regard, grooves 106 are in fluid communication with the drain pipe via basin 108. A trap 120, shown in FIG. 5, such as a ¾" S-trap or a U-trap, connects outlet 110 to the drain pipe that is connected to drain pipe port 104. Trap 120 can include oil instead of water, such as vegetable oil that doesn't evaporate and repels oil and blocks sewer gas from escaping.

It is therefore possible to provide a fluid outlet unit 100 that can be installed as a unitary piece of material and sized to fit any placement of a shower, stool, or water closet. Fluid outlet unit 100 provides adequate draining of any moisture that might accumulate between such shower, stool, or water closet and the subfloor to prevent or eliminate mold and contamination, which can lead to rotting odors or an environment for insects to thrive. Fluid outlet unit 100 can be adaptable to fit into any building codes adapted around the world, and can fit with any type of building material or subfloor, such as wood, steel, or concrete.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising." Any ranges given herein include any and all specific values within the range and any and all ranges within the given range.

The invention claimed is:

1. A fluid outlet unit comprising:

a rectangular plate comprising a top side and a bottom side each having a substantially flat surface across a length and a width of the rectangular plate, a circular hole in a center of the rectangular plate and a plurality of grooves in the to side of the plate that are oriented around the circular hole and that begin on the substantially flat surface and slope downward to the circular hole to channel moisture from the top side of the rectangular plate to the circular hole, wherein the rectangular plate is configured for placement under a floor board;

a basin positioned in the circular hole of the rectangular plate for receiving the moisture from the plurality of grooves, wherein the basin comprises of an inner wall, an outer wall, and a bottom surface between the inner wall and the outer wall that is positioned beneath the bottom side of the rectangular plate;

a drain pipe port concentric with the circular hole in the rectangular plate and extending upward from the basin to a position that is flush with the top side of the rectangular plate for connecting to the drain pipe, wherein the drain pipe port defines the inner wall of the basin; and an outlet in the bottom surface of the basin in fluid communication with the drain pipe to drain the moisture in the basin into the drain pipe; and a trap connected between the outlet and the drain pipe.

2. The fluid outlet unit of claim 1, wherein the fluid outlet unit comprises a single unitary piece of material.

3. The fluid outlet unit of claim 2, wherein the top side is at least substantially thirty five and eleven-sixteenths inches (35 11/16") long.

4. The fluid outlet unit of claim 2, wherein the top side is at least substantially three-quarters inches (¾") thick.

5. The fluid outlet unit of claim 2, wherein the fluid outlet unit consists of a molded polymer material.

6. The fluid outlet unit of claim 1, and further comprising oil in the trap.

7. A fluid outlet unit comprising:

a rectangular plate comprising a top side and a bottom side each having a substantially flat surface across a length and a width of the rectangular plate being at least substantially thirty five and eleven-sixteenths inches (35 11/16") long and at least substantially three-quarters inches (¾") thick, a circular hole in a center of the rectangular plate and having at least 10 grooves oriented around the circular hole to channel moisture from the top side of the rectangular plate to the circular hole, wherein the rectangular plate is configured for placement under a floor board;

a basin positioned in the circular hole of the rectangular plate for receiving the moisture from the at least 10 grooves, wherein the basin comprises of an inner wall, an outer wall, and a bottom surface between the inner wall and the outer wall that is positioned beneath the bottom side of the rectangular plate;

a drain pipe port concentric with the circular hole in the rectangular plate and extending upward from the basin to a position that is flush with the top side of the rectangular plate for connecting to the drain pipe, wherein the drain pipe port defines the inner wall of the basin; and an outlet in the bottom surface of the basin in fluid communication with the drain pipe to drain the moisture in the basin into the drain pipe; and a trap connected between the outlet and the drain pipe.

8. The fluid outlet unit of claim 7, wherein the fluid outlet unit comprises a single unitary piece of material.

9. The fluid outlet unit of claim 8, wherein the fluid outlet unit consists of a molded polymer material.

10. The fluid outlet unit of claim 8, and further comprising oil in the trap.

11. The fluid outlet unit of claim 1, wherein the outlet is at the bottom of the basin.

12. A fluid outlet unit comprising:

a rectangular plate comprising a top side and a bottom side each having a substantially flat surface across a length and a width of the rectangular plate, a circular hole in a center of the rectangular plate, a plurality of grooves in the top side of the rectangular plate to channel moisture from the top side of the rectangular plate to the circular hole, wherein the rectangular plate is configured for placement under a floor board;

a basin positioned in the circular hole of the rectangular plate for receiving the moisture from the plurality of grooves, wherein the basin comprises of an inner wall, an outer wall, and a bottom surface between the inner wall and the outer wall, wherein the inner wall is concentric with the outer wall, and the bottom surface is perpendicular to the inner wall and the outer wall and positioned beneath the bottom side of the rectangular plate;

a drain pipe port concentric with the circular hole in the rectangular plate and extending upward from the basin to a position that is flush with the to side of the rectangular plate for connecting to the drain pipe, wherein the drain pipe port defines the inner wall of the basin;

an outlet in the bottom surface of the basin in fluid communication with the drain pipe to drain the moisture in the basin into the drain pipe, wherein substantially all of the moisture in the basin drains directly into the outlet so that there is no standing water in the bottom of the basin; and a trap is connected and positioned between the outlet and the drain pipe so that water in the basin drain down into the trap.

13. The fluid outlet unit of claim 12, wherein the top side comprises of a substantially flat surface and the plurality of grooves begin on the substantially flat surface and slope downward toward the basin.

* * * * *